United States Patent [19]

Gates

[11] 4,034,956

[45] July 12, 1977

[54] APPARATUS FOR FORMING CRYPTS

[75] Inventor: H. Gordon Gates, Denver, Colo.

[73] Assignee: Gates & Sons, Inc., Denver, Colo.

[21] Appl. No.: 720,894

[22] Filed: Sept. 7, 1976

[51] Int. Cl.[2] ..... B28B 7/30

[52] U.S. Cl. ..... 249/180; 249/178; 249/184; 249/27

[58] Field of Search ..... 249/27, 178–185

[56] References Cited

U.S. PATENT DOCUMENTS

| | | | |
|---|---|---|---|
| 1,016,284 | 2/1912 | Meek et al. | 249/180 |
| 1,624,712 | 4/1927 | Berridge | 249/179 |
| 3,167,839 | 2/1965 | Gause | 249/185 |
| 3,774,875 | 11/1973 | Ecker | 249/180 |

*Primary Examiner*—Richard B. Lazarus

[57] ABSTRACT

A collapsible crypt form comprises an elongate rigid upper wall and two depending elongate rigid side walls joined at their adjacent margins by elongate rounded strips of resilient sheet material. Actuating means are connected to reinforcing rails at the lower edges of the side walls to extend them away from each other to operating position and retract them toward each other to reduce the effective height and width of the form for release from a finished recess. A back plate is held against the aft end of the body to prevent entry of flowable concrete and is disconnected from the body and removed from the recess after the body has been removed. A plurality of forms are placed in side by side spaced relation on a concrete slab with their forward ends in alignment with the forward edge of the slab and form plates are secured to the forms, locking them together and preventing loss of concrete. The concrete is poured and leveled to produce a tier of recesses with partition walls between them and a new slab above them. The process is repeated until the desired number of tiers are completed.

21 Claims, 17 Drawing Figures

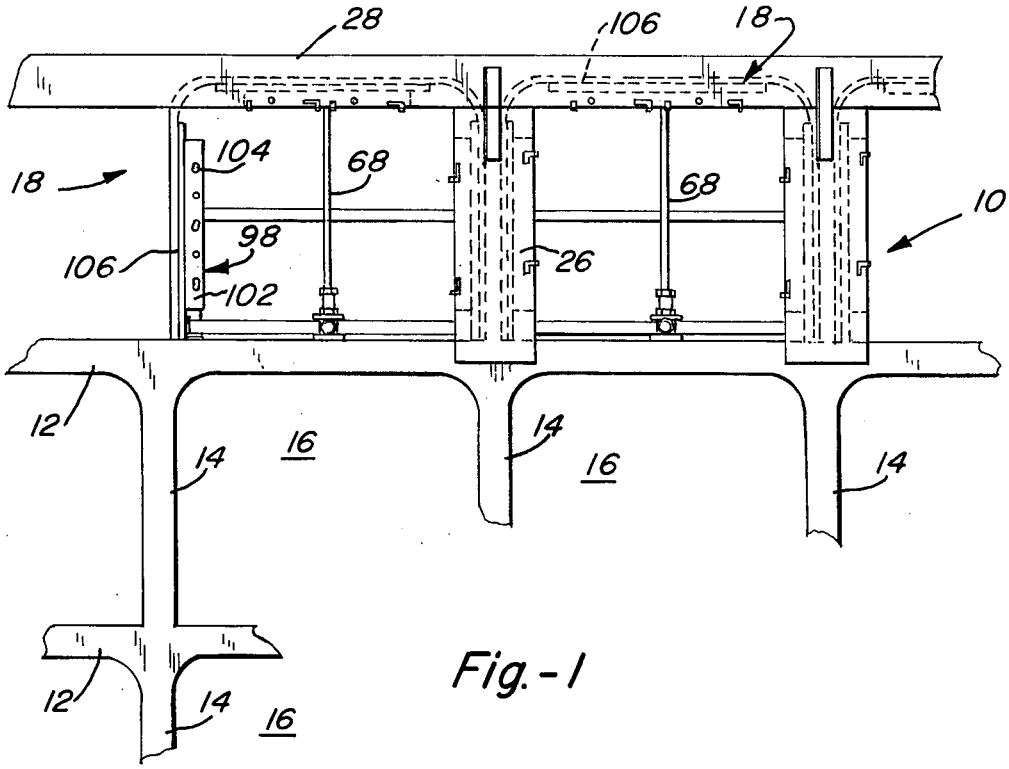
Fig.-1
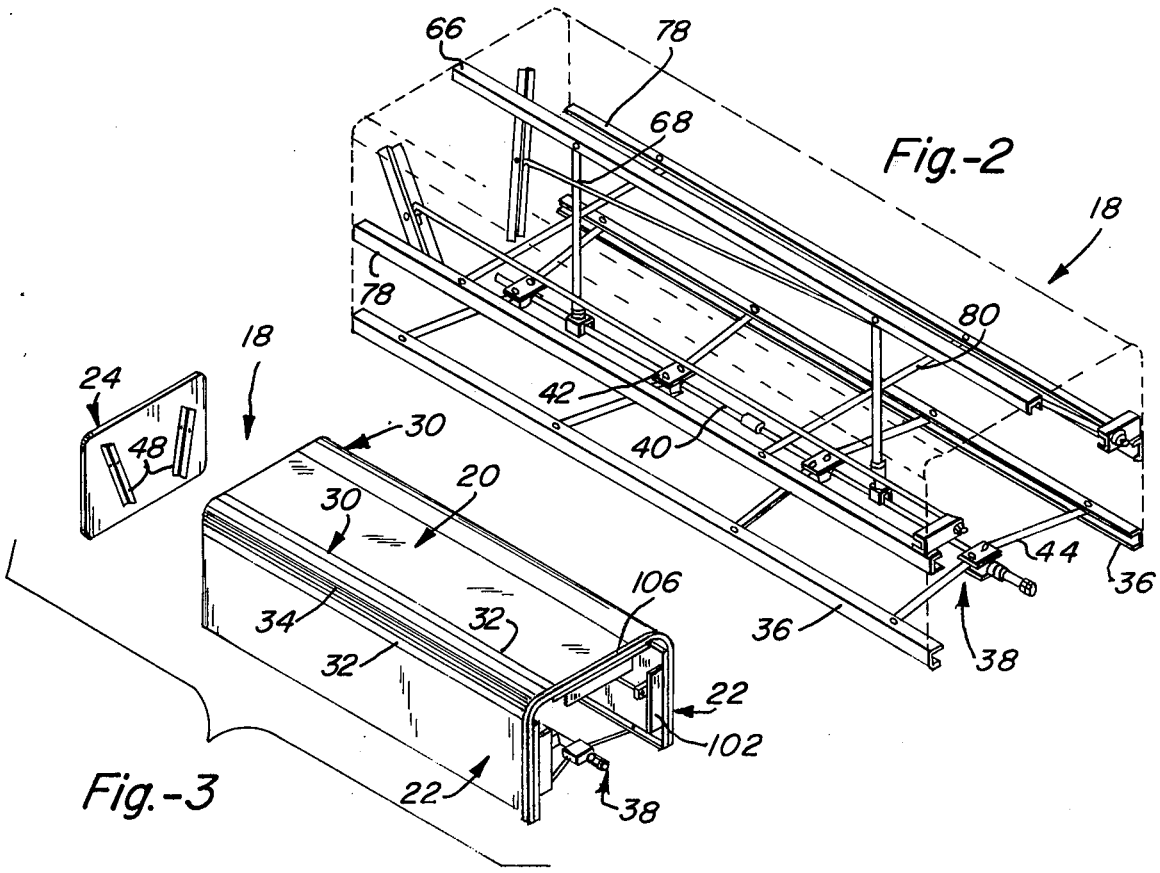
Fig.-2
Fig.-3

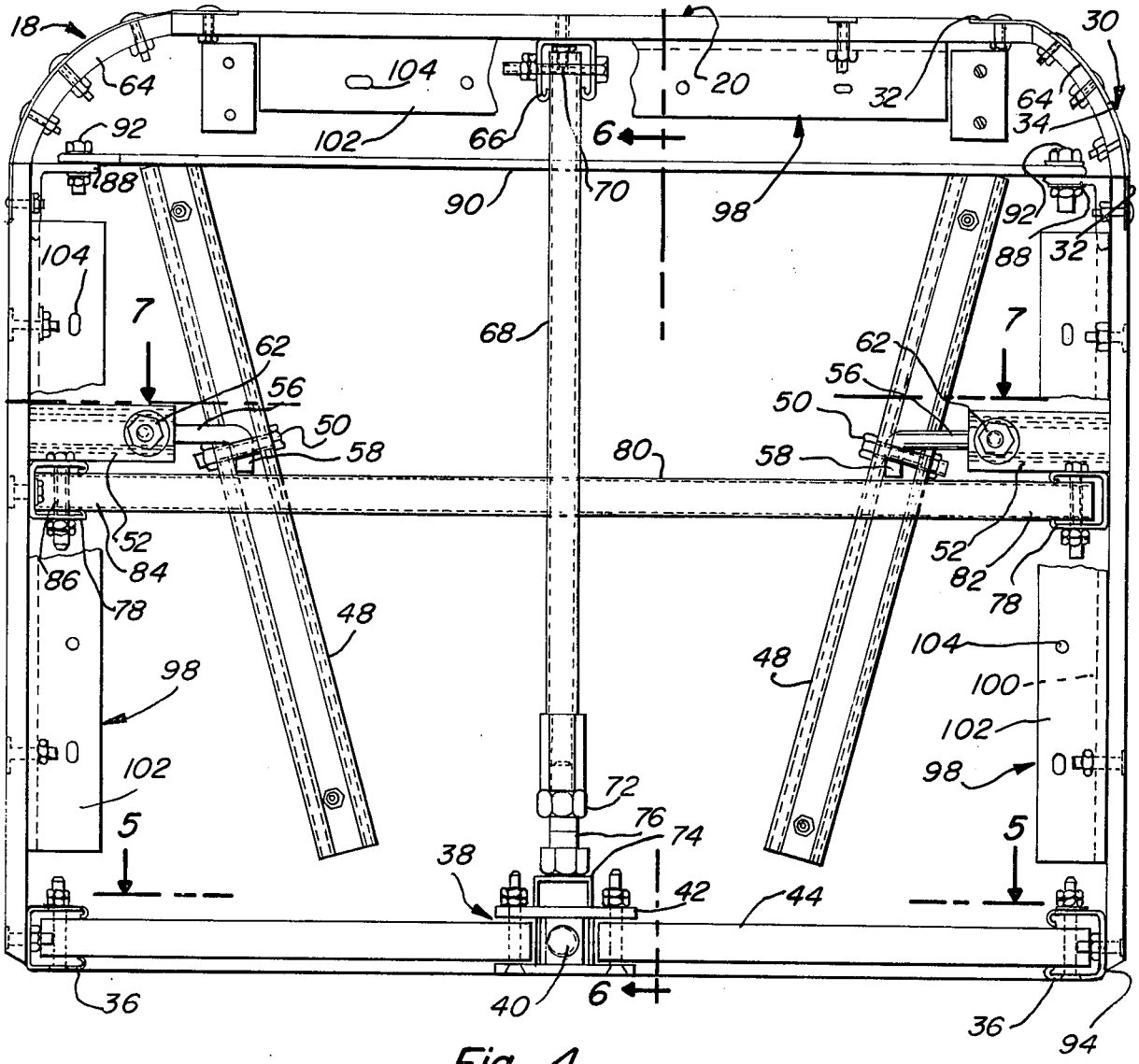
Fig.-4
Fig.-8
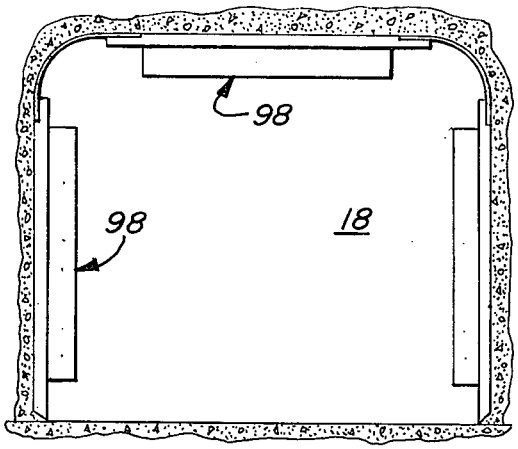
Fig.-9
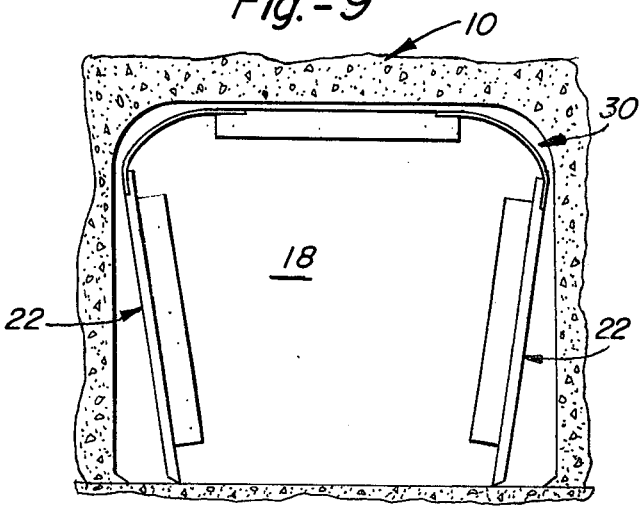

APPARATUS FOR FORMING CRYPTS

BACKGROUND OF THE INVENTION

The method and apparatus of this invention lie in the field of producing concrete structures with a plurality of uniform recesses. The invention is more particularly directed to producing mausoleum structures with several tiers of horizontally spaced crypts with minimum costs for labor and equipment.

Forms for pouring concrete foundations, walls, and the like have been made for many years with various types of lumber, including plywood. They are built up by carpenters using multitudes of nails and then must be torn apart for re-use. Since the concrete products are rather rough, the lumber can be used quite a few times in spite of the cumulative damage. Even so, the cost of the material is high and the labor is very expensive.

In cases where particular shapes are to be repeated many times it is possible to build up forms in a small number of composite sections which need not be completely torn down after each use. There is considerable saving in labor and in wear and tear on the lumber but the total cost is still high.

When hollow walls of various types are to be constructed it is necessary to use internal forms, or cores. Such cores are difficult to remove because they adhere to the recently set concrete and usually must be broken down to a great extent. Many kinds of collapsible cores have been proposed, using collapsible or separable walls or corners. While they are generally satisfactory in use they ordinarily have a multitude of relative movable parts requiring rather accurate fitting and complicated connecting means, rendering their first cost rather high and requiring a great deal of maintenance.

A great many mausoleums are being built at the present time. The basic portion of such a building is a monolithic concrete structure having a flat vertical front face pierced by a plurality of tiers of deep elongate crypts or recesses extending horizontally into the structure and arranged in side by side spaced relation with thin partition walls between them. The normal construction process includes preparing a base slab, mounting a plurality of core forms on the slab in spaced relation, pouring concrete to form the partition walls and produce a new slab, and removing the cores or forms, the process being repeated to complete the desired number of tiers.

The majority of such structures have been built using conventional built up wooden forms, some of them including prefabricated metal corner pieces. These forms are wedged so tightly in the hardened concrete recesses that they must completely broken down to remove them. Various collapsible forms have been proposed for use in this particular type of construction but they all suffer from various drawbacks. Some of them employ only a few components and are made of fiberglass and a suitable plastic binder. While they are simple they are generally inadequate becuase the walls of the form are not rigid enough to withstand the loading of the concrete and produce distorted recesses which make removal of the forms difficult. They also have inadequate protection against leakage of flowable concrete into the recess, requiring subsequent chipping operations to obtain a satisfactory finished recess. Other types employ a large number of separable parts which require high accuracy in manufacture and are difficult to assemble so that all of the parts fit together properly. Moreover they must be dismantled into many components in order to remove them from the recesses.

SUMMARY OF THE INVENTION

The apparatus and method of the present invention overcome the difficulties mentioned above and provide a system which is easy and economical to use. The forms have only a few major parts which are very rugged in construction and require virtually no maintenance. The forms remain almost totally assembled during placement and removal so that only a few minutes are required to remove a form and place it in position for the next operation.

Generally stated, the form in its presently preferred design comprises a main body having an upper wall, two depending side walls, and two corner connectors. The walls are elongate and generally rectangular and planar and are formed of substantially rigid material such as waterproof plywood having a thickness of the order of three quarters of an inch. The corner connectors are also elongate and of substantially the same length as the walls and are formed of resilient sheet material such as steel sheet having a thickness of the order of one sixteenth of an inch. Each connector comprises two elongate generally planar marginal attachment sections extending in planes generally perpendicular to each other and an elongate central section of laterally arcuate configuration.

The attachment sections of each connector are secured respectively along their length to one longitudinal marginal section of the upper wall and to the upper longitudinal marginal section of one of the side walls, with the connectors on the outer sides of the walls to provide a virtually flush surface. The assembly is thus in the form of an inverted rectangular channel having generally planar walls and rounded upper corners. Since the connectors are resilient, the lower edges of the side walls may be swung out to operating position, where they are vertical, and inward to substantial angular positions about the connectors as virtual hinges. In this movement the edges swing upward and reduce the effective height of the form and also its effective width. The connectors are also pulled in slightly by the movement of the walls and therefore the form is narrowed from top to bottom. This insures that the main body may be readily removed from a finished recess.

A reinforcing rail extends along the length of the lower portion of each side wall on its inner side and is fixedly secured thereto. An actuating means is provided to extend and retract the side walls as described above and in the presently preferred form it comprises an elongate actuator rod extending along the lower portion of the main body approximately midway between the sides with a plurality of toggle linkages spaced along the rod and mounted on it and connected to the reinforcing rails to force them toward and away from each other.

A back plate of rigid material, preferably the same as the walls, corresponds in size and shape to the lateral dimensions of the expanded main body and it is located in contact with the aft ends of the walls. Tie rods are provided to pull it tightly against the main body to prevent leakage of flowable concrete into the interior of the form.

A plurality of these forms are placed on a previously prepared concrete slab with their forward ends in alignment with the forward edge of the slab and they are arranged in spaced parallel relation. A vertically directed concrete form plate of steel is positioned to overlap the adjacent edges of two forms and bridge the gap between them. It extends down to overlie the front face of the slab and up to a point below the upper level of the forms and is secured to both forms to lock them in position. A similar plate is connected to successive pairs of forms in the same way. A second horizontally directed concrete form plate is butted against the top of the first plate and extends from the mid point of one form to the mid point of the other, while its upper margin extends above the level of the forms a distance corresponding to the thickness of the slab to be poured. This plate is also secured to both forms to further lock them in position, and similar plates are secured end to end along the length of the tier.

Concrete is now poured to fill the gaps between the forms and produce the partition walls between the recesses. Additional concrete is poured to produce a new slab above the forms, being leveled off at the upper margins of the horizontally extending form plates. When the concrete has hardened, the plates are removed and the tie rods are disconnected from the back plate. The toggle mechanism is actuated to retract the side walls and the main body is pulled out of the recess. The tie rods are then re-connected to the back plate and it is pulled out separately. The main body is now raised up and placed on the new slab directly above the recess from which it was just removed. The toggle mechanism extends the side walls to the proper operating position, the back plate is again secured in place, and the forms are adjusted to their proper alignment, after which the form plates are again attached. The system is now ready for another pouring operation. The entire cycle is carried out in a minimum length of time and with a minimum amount of labor. Since the major parts are few and very rugged the maintenance problem is virtually eliminated.

BRIEF DESCRIPTION OF THE DRAWINGS

Various other advantages and features of novelty will become apparent as the description proceeds in conjunction with the accompanying drawings, in which:

FIG. 1 is a fragmentary schematic front elevational view of a partially completed mausoleum structure with the components of the invention in operating position;

FIG. 2 is a schematic perspective view of the bracing and actuating components;

FIG. 3 is a schematic perspective view of the main body and the back plate;

FIG. 4 is a front elevational view of the form with all of its components in operating position;

FIG. 8 is a schematic front elevational view of the main body shell in extended position after the concrete has been poured;

FIG. 9 is a view similar to FIG. 8 showing the shell retracted to release it for removal from the finished recess;

DESCRIPTION OF PREFERRED EMBODIMENTS

Figure 5:
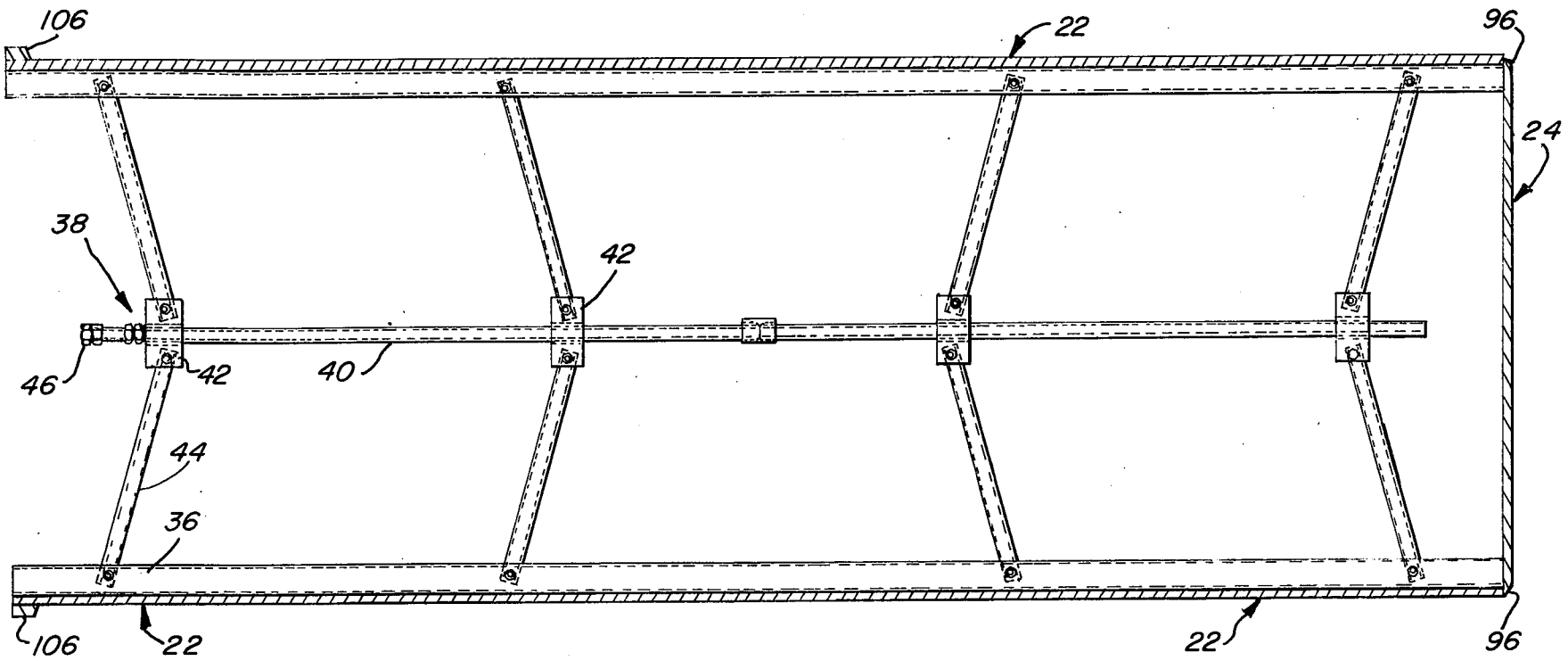
FIG. 5 is a sectional view taken on line 5—5 of FIG. 4.

The general arrangement of the major components of the invention in their operating position is illustrated in FIG. 1, in which a partially completed concrete structure 10 includes horizontal slabs 12 and vertical partition walls 14 defining between them tiers of depthwise elongate recesses 16 arranged in parallel spaced relation, closed at the aft end and open at the forward end, the forward face portions of the structure lying substantially in a vertical plane.

Each form 18 is composed of a shell having elongate upper and depending side walls 20 and 22 to form an inverted channel and a back plate 24 to close the aft end of the channel. The forms are mounted on slab 12 in parallel spaced relation directly above the previously formed recesses 16 with their forward edges in alignment with the forward edge of the slab. Vertical concrete form plates 26 overlie a lower slab 12 and overlap the forward ends of two adjacent or successive forms to bridge the gap between them. Horizontal concrete form plates 28 overlie the upper portions of the forms and extend above them to provide a dam for pouring the next slab. Plates 26 and 28 are secured to successive forms to lock them together during the pouring operation. When the concrete has hardened, the plates and forms are removed and mounted on the new slab in the same way for the pouring of the next tier.

The principal details of the form are shown schematically in FIGS. 2, 3, and 4. The shell includes upper wall 20, depending side walls 22, and corner connectors 30. The walls are elongate and generally rectangular and planar and are formed of substantially rigid material, such as waterproof plywood having a thickness of the order of three quarters of an inch. The corner connectors are elongate and generally rectangular and are of substantially the same length as the walls. They are formed of thin resilient sheet material, preferably steel sheet, having a thickness of about one sixteenth of an inch, the thickness being from about 10 percent to about 20 percent of the thickness of the walls.

Each connector comprises two elongate generally planar marginal attachment sections 32 extending in planes generally perpendicular to each other and an elongate central section 34 of laterally arcuate configuration. Sections 32 are secured respectively to one longitudinal marginal section of the upper wall and to the upper longitudinal marginal section of one of the side walls, fitting into shallow recesses on the outer sides of the walls in flush relation to define an assembly in the form of an inverted rectangular channel having generally planar walls and rounded upper corners.

A reinforcing rail 36, preferably in the form of a channel bar, extends longitudinally along the lower portion of each side wall on its inner side and is fixedly secured thereto. A multiple toggle actuating assembly 38, best seen in FIGS. 2 and 5, is located in the lower portion of the main body, or shell, and includes an elongate actuator control rod 40 running parallel to the longitudinal axis of the form, a plurality of toggle blocks 42 spaced along the length of the rod, and toggle links 44 pivotally connected at their ends to the toggle blocks and rails 36. The two halves of rod 40 are oppositely threaded and the blocks are correspondingly threaded. When a tool is applied to the tool engaging formation 46 at the forward end of the rod and rotated, the toggle linkages operate in known manner to extend the rails and the lower portions of their side walls away from each other or to retract them toward each other.

When the walls are extended, as seen in FIGS. 1, 4, and 8, the form is rectangular and ready for use in pouring. When the concrete has hardened, the actuating assembly 38 is operated to retract the rails until the side walls have swung in toward each other to the position shown in FIG. 9. The walls move inward and upward about the connectors as virtual pivots and therefore the effective height of the main body is reduced. The same action pulls the resilient connectors slightly inward toward the center and therefore the effective width of the main body is also reduced. Since the body is now smaller than the recess it is released, and may be pulled out to be re-adjusted and re-used.

Back plate 24 is sized and shaped to conform to the dimensions of the aft end of the main body when it is extended and ready for use. Thus it is generally rectangular with rounded upper corners. It is fastened against the aft end of the main body to seal it off and prevent leakage of flowable concrete into the interior of the form. For this purpose a pair of reinforcing rails 48 are secured to its inner face as seen in FIG. 4. These rails are in the form of channel bars and a bolt 50 is passed through the lateral walls of each bar and secured with a nut to constitute an anchorage. A bracket 52 is secured to the inside of each side wall near its forward end and formed with a longitudinally directed aperture 54 to serve as a second anchorage. A pair of elongate tie rods 56 are provided with hooks 58 at their inner ends and threaded portions 60 at their outer ends. Each tie rod is inserted through an aperture 54 and its hook 58 is engaged with an anchorage 50. A nut 62 is threaded on portion 60 and tightened to pull the back plate firmly into sealing engagement with the aft end of the main body and retain it during use. When the concrete has hardened, the tie rods are removed and the main body is pulled from the recess as previously described. The tie rod is then hooked to the anchorage 50 and used to pull the back plate out of the recess.

While the back plate 24 can be pulled into good sealing engagement with the aft ends of the thick walls it is apparent that it would be difficult to seal it well against the thin edge of the corner connector 30. Therefore a flexible gasket strip 64 of about the same thickness as the walls and somewhat greater width is secured to the inner side of each connector flush with its aft edge and extending along the arcuate span from each side wall to the upper wall.

Figure 11:
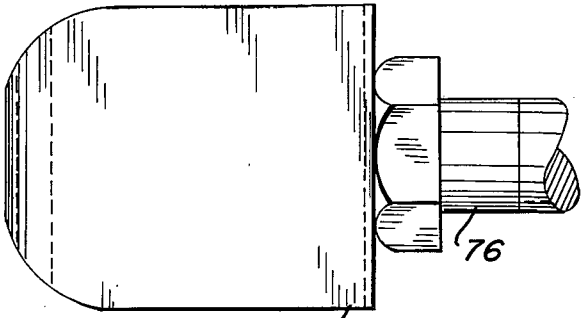
FIG. 11 is a view similar to FIG. 10, showing the foot in plan.
Figure 10:
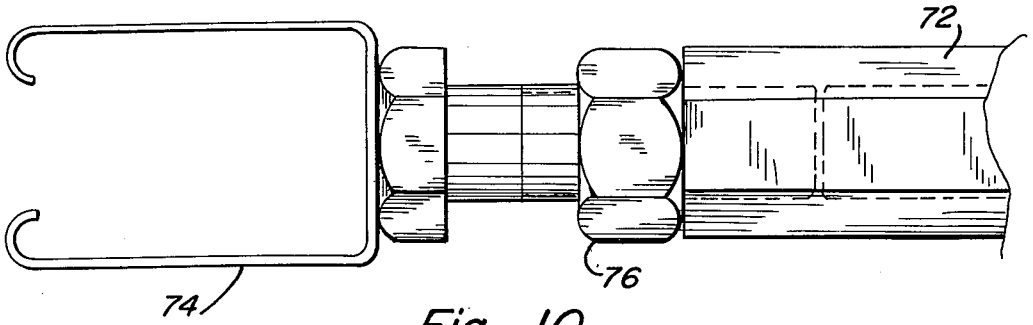
FIG. 10 is an elevational view of the lower portion of a vertical brace strut.

A reinforcing rail 66 is secured to the inside of the upper wall and is substantially coextensive with it. A pair of brace struts 68 are spaced along its length and have their first ends 70 pivotally connected to the rail while their second ends 72 are swingable downwardly into contact with the supporting floor to support the upper wall against vertical loads. As seen in FIGS. 4, 10, and 11, end 72 includes a channel shaped foot 74 which straddles actuator rod 40 and an adjustable connector member 76 between the foot and the remainder of the strut. Since the design of some structures includes a slight longitudinal depression in the floor of each crypt, this feature takes care of the necessary variation in strut length.

A longitudinally extending reinforcing rail 78 is secured to the inner side of each side wall 22 and a pair of brace struts 80 are spaced along the length of one of them, each strut having a first end 82 pivotally connected to the rail while its second end 84 is swingable laterally into contact with the opposite rail and positioned by a stop 86. These struts support the side walls against the inward force of the flowable concrete in the gaps between forms.

Brackets 88 are secured to the inner walls adjacent to their upper margins and to their fore and aft ends. Tension tie rods 90 of heavy wire extend across the main body and are secured by bolts 92 to opposing brackets. These tie rods act in tension to prevent spreading of the upper edges of the walls away from each other under the influence of heavy vertical loads on the upper wall 20 but are resilient enough to bend under compression loads and thus do not prevent inward movement of the upper margins of the side walls when the main body is contracted to release it from the finished recess.

Figure 6:
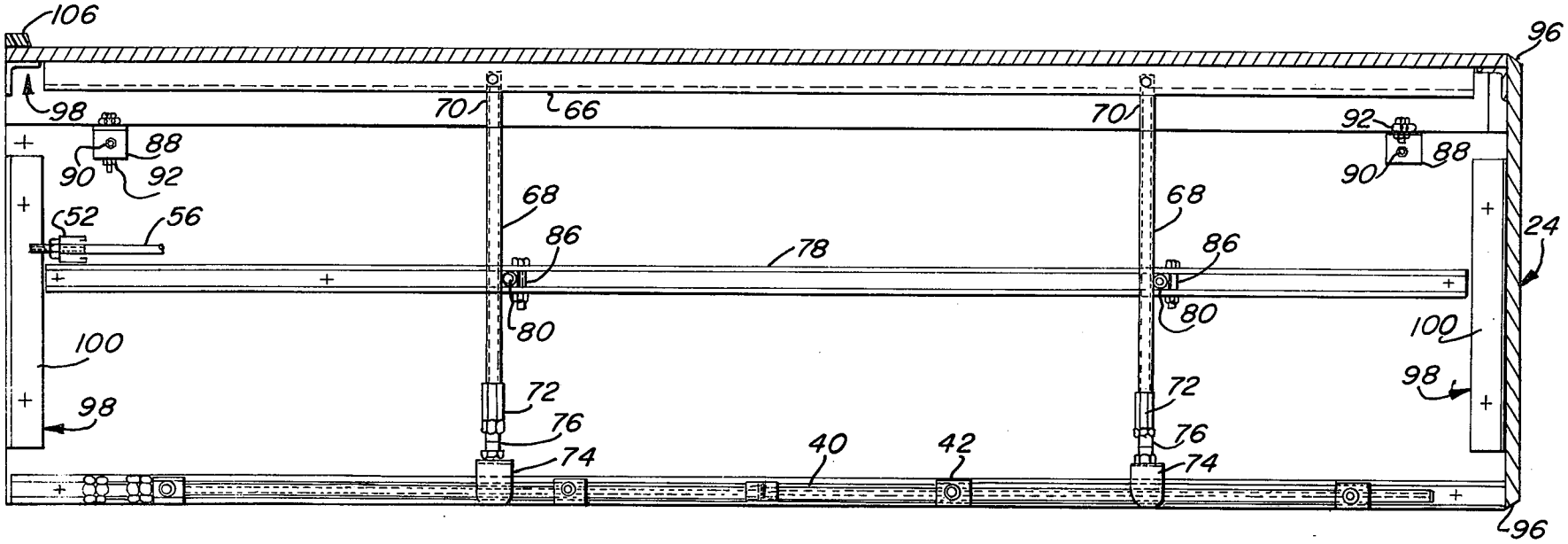
FIG. 6 is a sectional view taken on line 6—6 of FIG. 4.
Figure 7:
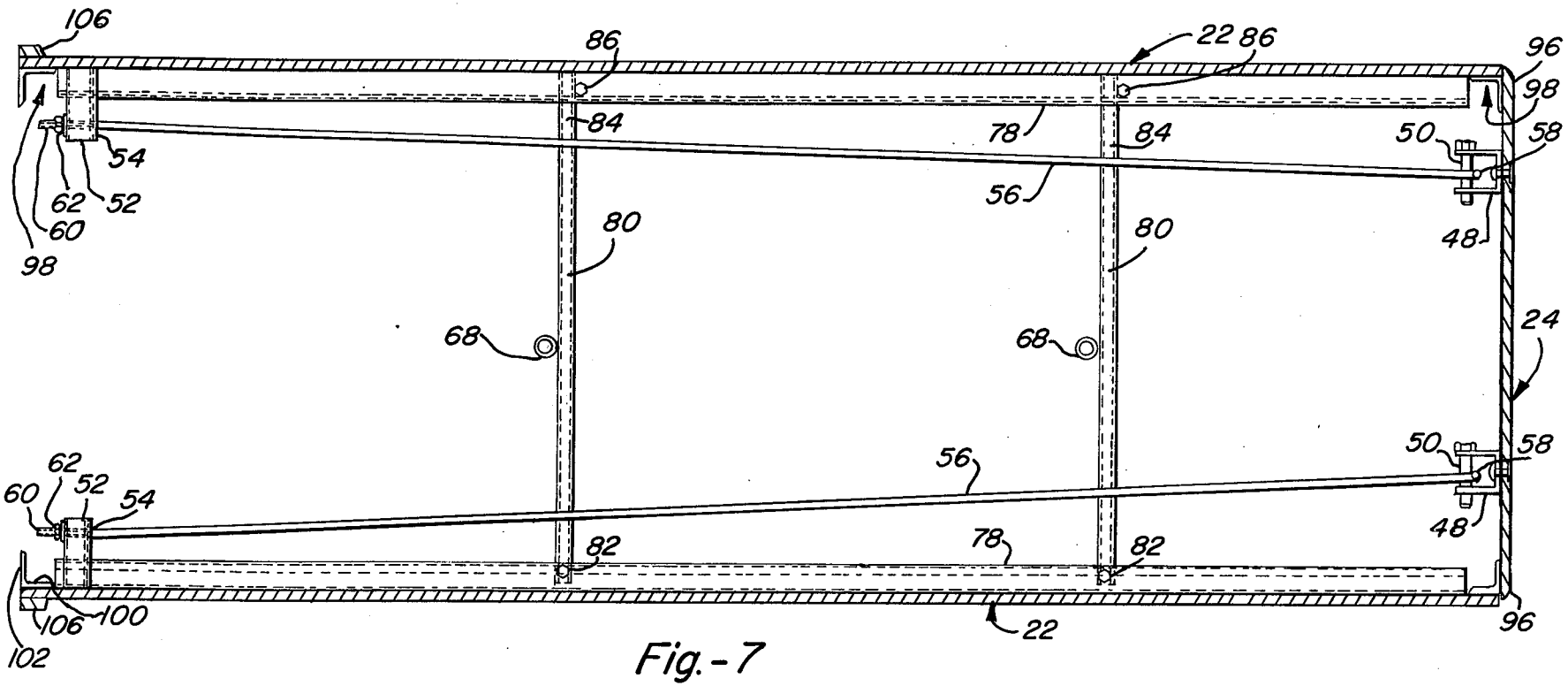
FIG. 7 is a sectional view taken on line 7—7 of FIG. 4.

The lower outer marginal corners 94 of the side walls are relieved by chamfering or rounding as indicated in FIG. 4 to facilitate release of the wall from the hardened concrete. All of the aft corners 96 of the back plate 24 are similarly relieved as indicated in FIGS. 5, 6, and 7 for the same purpose.

As will be seen in FIG. 4, reinforcing rail 36 is mounted to the side wall in such position that it extends slightly below the marginal edge of the wall. Thus it takes the load of the main body and protects the margin of the wall against damage when it is dragged across the concrete during removal and mounting in new operating positions.

Mounting brackets 98 are provided on the inner sides of each of the three walls. They comprise elongate angle irons having a first flange 100 secured to the wall and a second flange 102 extending inwardly and lying in a plane flush with the forward edges of the main body, and provided with a series of connection apertures 104. As seen in FIG. 1, when plate 26 is placed in position a plurality of wedge locks are used to secure the plate to flanges 102. Each lock has a pilot pin which engages through an aperture in the plate and a corresponding aperture 104 in the flange. The lock has a reversely bent clamping jaw which grips the flange and the edge of the plate when the lock is rotated about the mounting pin. Plates 28 are secured to the flanges 102 in the same manner.

A corresponding set of mounting brackets are provided at the aft end of the main body. When it is desired to form double depth recesses, two main bodies are arranged end to end in tandem and the mounting brackets are bolted together to double the length of the form. A back plate is then applied to the aft end of the rearmost body.

Although plates 26 and 28 are clamped to the forward edges of the main body it is desirable to increase the sealing protection of the joint as much as possible. Accordingly a flexible gasket strip 106 is provided which is secured to the outer side of the main body and extends along its extreme forward edge from the bottom of one wall 22, over the upper wall, and down to the bottom of the other wall 22. It is preferably about as thick as the walls and its width is about twice its thickness. It contacts the form plates initially to seal off the interior of the form, and the flowable concrete deforms and compresses it even more positively against the line of jointure during the setting of the concrete.

Figure 16:
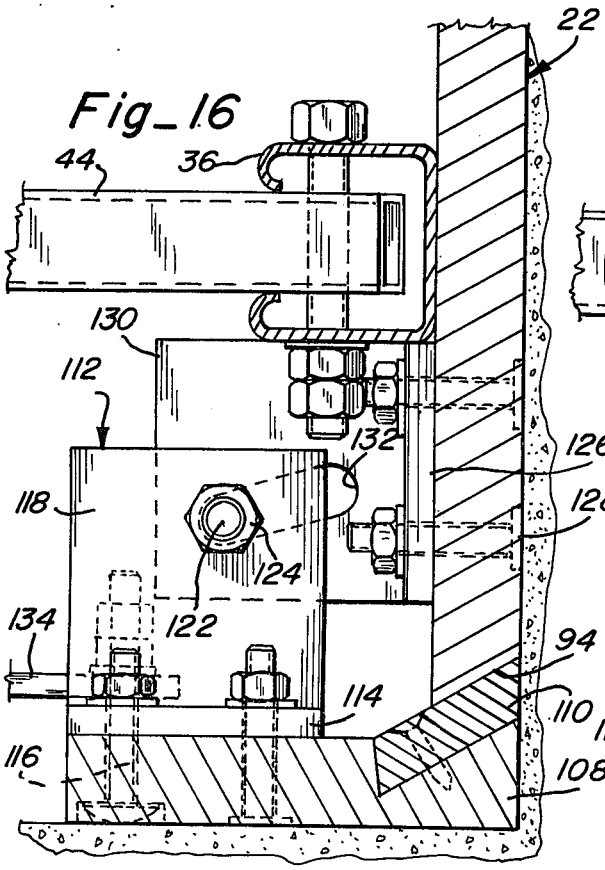
FIG. 16 is a fragmentary end elevational view, partly in section, taken on line 16—16 of FIG. 12.
Figure 17:
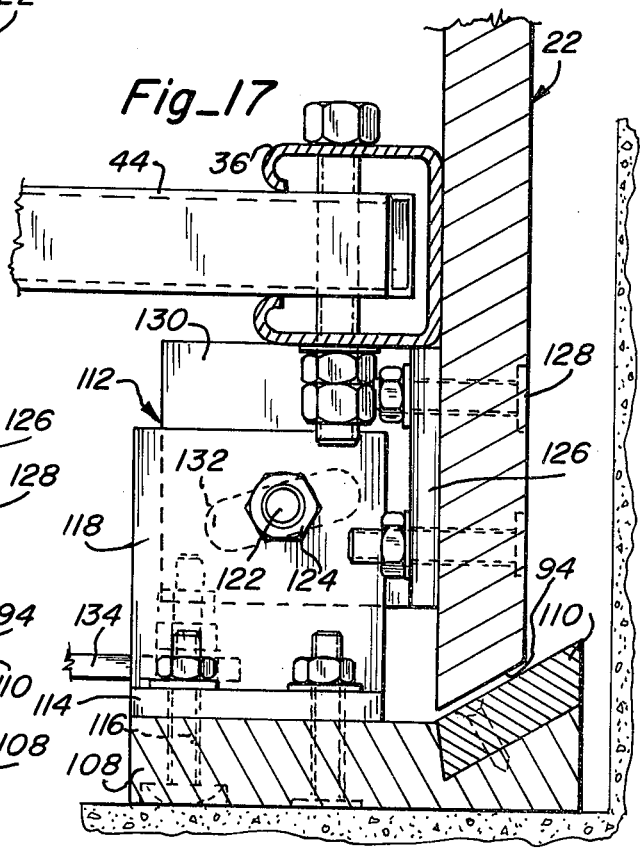
FIG. 17 is a view similar to FIG. 16, showing the parts in adjusted position.

In the modified form illustrated in FIGS. 12 to 17 the basic structure of the apparatus is substantially identical to the form previously described. In the modification, a separate narrow elongate foot 108 is provided under the lower marginal edge of each side wall 22 and extends along its entire length. The outer portion of the upper surface of the foot along its length is formed by a slide plate 110 of metal such as aluminum. The upper surface of the plate is angled upward and outward, as shown in FIGS. 16 and 17, and the chamfered lower marginal edge 94 of wall 22 is angled inward and downward at a corresponding angle. When the form is extended to operating position the outer edge of each foot is aligned with the outer face of each wall as indicated in FIG. 16.

After the concrete has hardened, the walls are retracted by the toggle actuating assembly 38, and each wall slides downwardly and inwardly on its respective plate 110 as indicated in FIG. 17. The two parts are maintained in assembled relation and their relative movement is limited by a pin and slot cam arrangement 112. A plurality of such cam connections are located along the length of each side of the form.

At each station a pair of angle brackets are mounted on the foot in longitudinally spaced relation. Each bracket has a horizontal flange 114 secured to the foot by bolts 116 and a vertical flange 118 with a longitudinally directed aperture 120. A pin or bolt 122 passes through the apertures to span the gap between the flanges and is secured by jam nuts 124. A cooperating member is mounted on wall 22 and comprises a first flange 126 secured to the wall by bolts 128 and a second flange 130 extending inward between flanges 118. Flange 130 is formed with an inclined cam slot 132 through which bolt 122 passes to maintain the parts in assembled relation. The slot is angled upward and outward at the same angle as the upper face of plate 110. Thus, as wall 22 moves inward and downward bolt 122 moves relatively upward and outward at the same rate.

Figure 13:
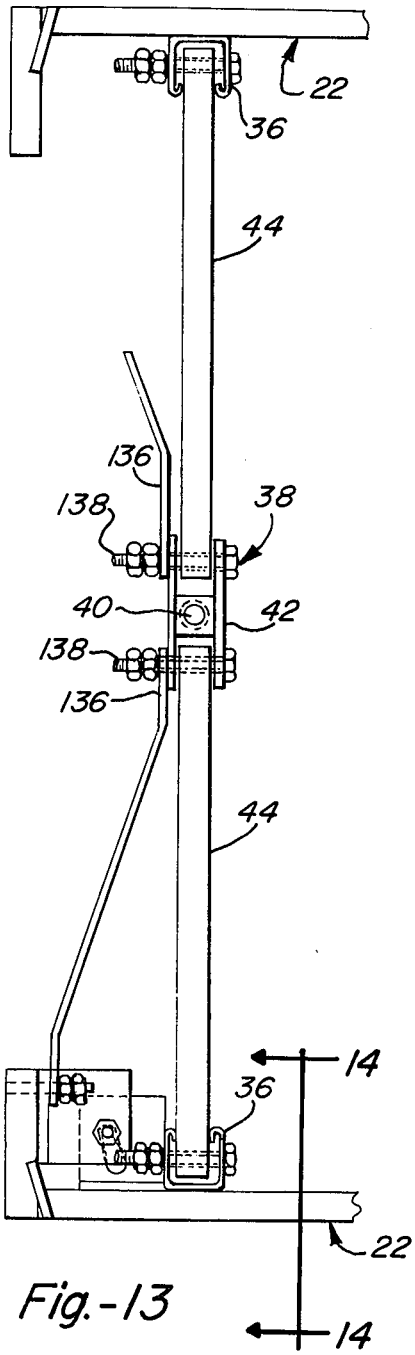
FIG. 13 is an end elevational view taken in the direction of line 13—13 of FIG. 12.
Figure 12:
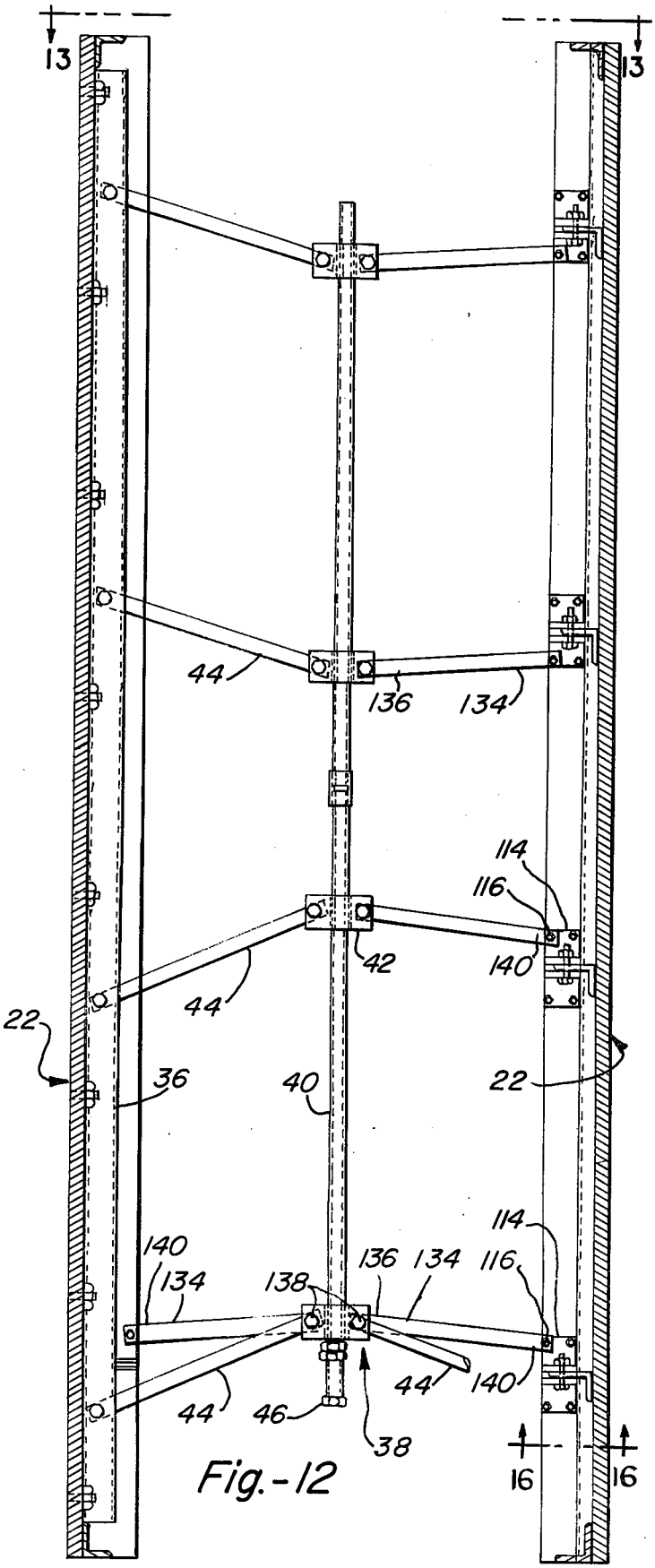
FIG. 12 is a plan view, partly in section, of the lower portion of a modified version.
Figure 14:
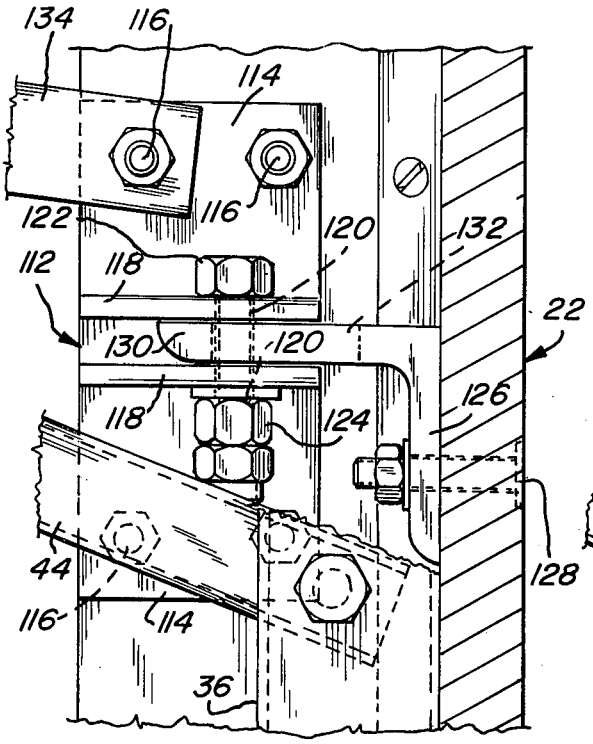
FIG. 14 is a fragmentary plan view, partly in section, taken on line 14—14 of FIG. 13.
Figure 15:
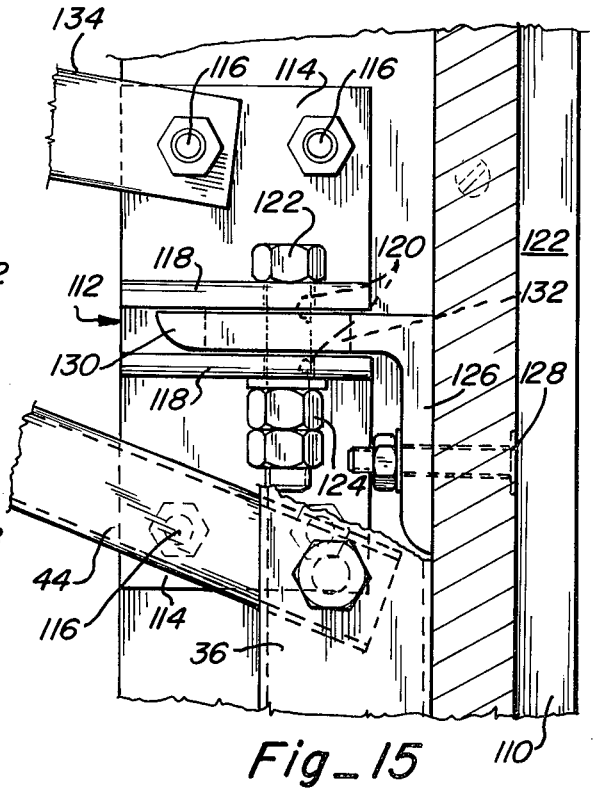
FIG. 15 is a view similar to FIG. 14, showing the parts in adjusted position.

While the cam connection 112 just described can move foot 108 inward when bolt 122 reaches the right hand end of slot 132 it is preferred to provide mechanism which will move the foot inward and outward positively and at a lesser rate than the movement of the wall. To accomplish this, as best seen in FIGS. 12 and 13, a second set of toggle links 134 is provided to work in conjunction with toggle links 44. Each link 134 has a first end 136 pivotally connected to a toggle block 42 below link 44 by a bolt 138, and a second end 140 pivotally connected to a flange 114 on foot 108 by a bolt 116.

As is well known, all of the toggle links must extend laterally at angles other than 90° to the longitudinal axis of the actuator rod to function effectively. Moreover, the less the angle to the control rod the greater will be the lateral movement of the outer end of the toggle link. It will be seen in FIG. 12 that the included angle between each pair of links 44 is less than the included angle between each pair of links 134. Therefore any given longitudinal movement of toggle blocks 42 will cause a greater amount of lateral movement of walls 22 then of feet 108. Thus, as seen in FIG. 16, the wall and the foot are initially in alignment at the commencement of the releasing operation. As the toggle assembly is actuated wall 22 moves inward faster than foot 108 and in FIG. 17 it will be seen that the movement of the wall has been about twice that of the foot. Therefore wall 22 has been released and has descended so that the total effective height of the form is reduced, and upper wall 20 is free of the concrete. Also foot 108 is free of the side wall of the recess. Thus the main body is totally free and may be removed with ease.

I claim:

1. A collapsible form for use in pouring concrete structures having a plurality of elongate recesses in side by side spaced relation, comprising:

a main body having an upper wall, two depending side walls, and two corner connectors;

the upper and side walls being elongate and generally rectangular and planar and being formed of substantially rigid material;

the corner connectors being elongate and generally rectangular and formed of resilient sheet material and being of substantially the same length as the walls;

each connector comprising two elongate generally planar marginal attachment sections extending in planes generally perpendicular to each other and an elongate central section of laterally arcuate configuration;

the attachment sections of each connector being secured respectively to one longitudinal marginal section of the upper wall and to the upper longitudinal marginal section of one of the side walls to define an assembly in the form of an inverted channel having generally planar walls and rounded upper corners;

a reinforcing rail extending longitudinally along the lower portion of each side wall on its inner side and fixedly secured thereto;

actuating means locate in the lower portion of the main body and connected to the reinforcing rails and actuatable to force the rails away from and toward each other to expand and contract the main body laterally;

a back plate of rigid material corresponding in size and shape to the lateral dimensions of the expanded main body and located in contact with the aft ends of the walls to close the aft end of the main body;

anchorage means on the inner side of the back plate;

anchorage means at the forward portion of the main body;

and at least one elongate tie rod having means to engage both of said anchorage means and actuatable to draw and hold the back plate in firm engagement with the aft end of the main body.

2. A form as claimed in claim 1; in which the actuating means comprises a multiple toggle assembly extending longitudinally and including a longitudinal actuator rod having a tool engaging formation at its forward end and a plurality of longitudinally spaced toggle linkages mounted on the rod and extending laterally and connected to the reinforcing rails to force the rails apart and toward each other and expand and contract the main body laterally.

3. A form as claimed in claim 1; in which
a reinforcing rail is provided which extends longitudinally on the inner side of the upper wall substantially on the longitudinal axis and is secured thereto;
and at least one brace strut is provided, with a first end pivotally connected to the rail and a second end swingable downward into contact with a supporting floor to brace the upper wall against vertical loads.

4. A form as claimed in claim 1; in which
a reinforcing rail is provided extending longitudinally on the inner side of each side wall and is secured thereto;
and at least one brace strut is provided, with a first end pivotally connected to one rail and a second end swingable laterally into contact with the other rail to brace the side walls against inward forces produced by flowable concrete.

5. A form as claimed in claim 1; in which
a pair of laterally spaced anchorage means are provided on the back plate;
the anchorage means at the forward portion of the main body comprises a bracket fixed to the inner side of each sidewall and provided with a longitudinally directed aperture therethrough;
and a pair of tie rods are provided, each passing through the aperture in one of the brackets and having a hook at its inner end to engage an anchorage on the back plate and having a threaded portion at its outer end for reception of a threaded fastener to engage the bracket and apply tension to the tie rod to draw the back plate into firm engagement with the aft end of the main body.

6. A form as claimed in claim 1; in which
the outer corners of the lower marginal sections of each side wall are relieved to facilitate release from the hardened concrete of a finished recess.

7. A form as claimed in claim 1; in which
the aft corners of the marginal sections of the back plate are relieved to facilitate release from the hardened concrete of a finished recess.

8. A form as claimed in claim 1; in which
the reinforcing rails along the lower inside portions of the side walls are located to extend slightly below the edges of the side walls to protect them against frictional wear and damage during operation of the form.

9. A form as claimed in claim 1; in which
the lower edges of the main body swing inwardly and upwardly during contraction to reduce the effective height of the main body;
and the contraction movement deflects the resilient corner connector inwardly to reduce the effective width of the main body;
the double reduction in cross section serving to release the main body from the finished recess.

10. A form as claimed in claim 1; in which
the corner connectors are very thin compared to the walls;
the cooperating marginal sections of the walls being recessed on their outer faces to receive the marginal sections of the connectors in flush relation to provide a smooth outer surface on the main body.

11. A form as claimed in claim 1; in which
the thickness of the corner connectors is from about 10 percent to about 20 percent of the thickness of the walls.

12. A form as claimed in claim 11; in which
the material of the corner connectors is steel sheet.

13. A form as claimed in claim 1; in which
the adjacent longitudinal marginal sections of the walls are spaced a substantial distance apart;
the corner connectors are secured to the outer sides of the walls with their arcuate central sections bridging the gaps;
and flexible gasket strips are secured on the inner faces of the aft ends of the central arcuate sections extending between adjacent walls to assist in sealing the interior of the form against leakage of flowable concrete.

14. A form as claimed in claim 1; in which
a flexible gasket strip is secured to the outer side of the main body at its extreme forward end extending over all of the walls and the corner connectors to contact concrete form plates secured to the forward end of the main body and seal against leakage of flowable concrete into the interior of the form.

15. A form as claimed in claim 1; in which
a mounting bracket is provided for each wall of the main body, the brackets being elongate and secured to the inner side of each wall at its forward marginal edge and serving to support concrete form plates in position against the forward edges of the walls.

16. A form as claimed in claim 15; in which
a corresponding set of mounting brackets is provided along the aft marginal edges of the walls to confront the forward brackets of a second main body and be locked together to maintain the two main bodies in tandem force and aft relation for the pouring of a double depth recess.

17. A form as claimed in claim 1; in which
brackets are provided on the inner sides of the side walls adjacent to their upper margins near the forward and aft ends;
and laterally extending tension tie rods are attached at their ends to opposing brackets to prevent the upper portions of the side walls from spreading apart in response to vertical loads on the upper wall.

18. A form as claimed in claim 1; in which
a separate narrow elongate foot is movably connected to the lower marginal portion of each side wall and is coextensive with its length to provide ground engaging support for the wall;
the upper surface of the foot along its outer portion being angled upward and outward;
the lower margin of the wall being angled downward and inward at a corresponding angle to seat firmly on the foot when the main body is expanded to its normal operating extent;
the lower margin of the foot being movable inwardly with respect to the foot in response to operation of the actuating means and downwardly along the angled surfaces to reduce its effective height.

19. A form as claimed in claim 18; in which
the wall and the foot are provided with cooperating cam members to cause the wall to descend with respect to the foot during inward movement and to rise with respect to the foot during outward movement.

20. A form as claimed in claim 19; in which
the wall is provided with a laterally extending bracket formed with an upwardly and outwardly direct cam slot and the foot is provided with upstanding bracket means carrying a fixed cam follower for engagement in the cam slot.

21. A form as claimed in claim 18; in which the actuating means comprises a multiple toggle assembly extending longitudinally in the lower portion of the main body and including a longitudinal actuator rod having a tool engaging formation at its forward end and a plurality of longitudinally spaced toggle blocks mounted on the rod;

a first pair of links pivotally connected to each toggle block and to the reinforcing rails;

and a second pair of links pivotally connected to each toggle block and to the feet;

all of the links extending laterally at angles other than 90° to the longitudinal axis of the rod;

and the included angle between the links of the first pair being substantially less than the included angle between the links of the second pair to extend and retract the lower portions of the walls at a greater rate than the feet.

* * * * *